United States Patent [19]

Willson

[11] 3,943,040

[45] Mar. 9, 1976

[54] MICROCRACKED CHROMIUM FROM A BATH USING AN ORGANIC SULFUR COMPOUND

[75] Inventor: Karl Stuart Willson, Cleveland, Ohio

[73] Assignee: The Harshaw Chemical Company, Cleveland, Ohio

[22] Filed: Sept. 20, 1974

[21] Appl. No.: 507,842

[52] U.S. Cl. ..... 204/51
[51] Int. Cl.[2] ..... C25D 3/10
[58] Field of Search ..... 204/51, 105 R

[56] References Cited

UNITED STATES PATENTS

| | | | |
|---|---|---|---|
| 3,745,097 | 7/1973 | Chessin et al. | 204/51 |
| 3,758,390 | 9/1973 | Chessin et al. | 204/51 |
| 3,804,728 | 4/1974 | Chessin et al. | 204/51 |

*Primary Examiner*—G. L. Kaplan

[57] ABSTRACT

This invention covers the use of a selected group of sulfo-organic compounds as addition agents and particularly as microcracking agents in the electrodeposition of chromium from a conventional chromium plating bath. A particularly effective compound is thio diethanol, which when added to a fluosilicate bath gives a fine microcracked deposit in 2½ and 6 minutes. At shorter plating times, this compound improves the covering power of the bath.

10 Claims, No Drawings

MICROCRACKED CHROMIUM FROM A BATH USING AN ORGANIC SULFUR COMPOUND

BACKGROUND OF THE INVENTION

1. Field of the Invention

This invention relates to the formation of an electrodeposit of chromium upon a conductive substrate. More particularly, the invention relates to the electrodeposition of chromium capable of forming a fine, uniform network of microcracks. This network provides improved corrosion protection for the substrate. The chromium is deposited from an aqueous bath containing a specific organic sulfur compound in an amount effective to produce a uniform microcrack pattern. Suitable organic sulfur compounds are thio diethanol, thio diacetaldehyde, thio diacetic acid and the corresponding sulfinyl and sulfonyl derivatives thereof. Other suitable compounds are disulfonated ethanol, disulfonated acetaldehyde, disulfonated acetic acid and the acid salts thereof.

2. Discussion of the Prior Art

In the field of decorative chromium electroplating, a principal objective has been traditionally to obtain a uniformly bright or lustrous deposit that provides adequate corrosion protection to the article being electroplated. This protection was thought to relate to and be dependent on the continuity of the electrodeposits.

Recently, however, the advantage of producing a discontinuous chromium layer having a fine system of micropores or microcracks has been recognized. These micropores or microcracks result in a substantial improvement in the corrosion protection of the plated article. Various mechanisms have been used for developing the microcracks or micropores including the following:

A. Electrodepositing onto a conductive substrate a highly stressed layer of nickel followed by a stressed layer of chromium, with the two layers interacting to develop a pattern of cracks. This is more completely described in U.S. Pat. No. 3,563,864.

B. Depositing discrete solid particles in or on a layer of nickel or cobalt followed by the electrodeposition of a thin chromium layer in a discontinuous manner around each particle. An example of this is shown in U.S. Pat. No. 3,152,971.

C. Lightly impinging small particles of sand or the like against a thin layer of chromium to form micropores extending through the layer and into the layer of nickel or cobalt therebeneath. This is more completely described in U.S. Pat. No. 3,625,039.

D. Inducing stress in the chromium layer by incorporating a suitable microcracking agent or stress producer into the chromium plating bath as described in U.S. Pat. No. 3,758,390. The crack throw and covering power of the bath is not, however, totally satisfactory.

BRIEF DESCRIPTION OF THE INVENTION

The present invention relates to a chromium plating bath to which is added a sulfo-organic microcracking agent, and to a process of using this bath in the production of a highly protective decorative electrodeposit of chromium.

The microcracking agent is selected from one of the following groups of compounds:

1) $Z_1-CH_2-S(O)_n-CH_2-Z_2$ and

2) 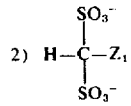

where $n$ is an integer between 0 and 2 inclusive and where $Z_1$ and $Z_2$ are independently selected from the group consisting of —CHO, $—CH_3$, $—CH_2OH$ and —COOH and the soluble salts thereof. The agent is used in an amount effective to develop a fine network of microcracks in the layer of chromium during a plating time of between 2½ and 10 minutes. The microcracking agent is typically added as a soluble solid or an aqueous solution thereof to a chromic acid plating bath containing $SiF_6=$ and $SO_4=$ ions.

Suitable organic sulfur compounds are thio diethanol, thio diacetaldehyde, thio diacetic acid and the corresponding sulfinyl and sulfonyl derivatives thereof. Other suitable compounds are disulfonated ethanol, disulfonated acetaldehyde, disulfonated acetic acid and the salts thereof.

Plating is conducted at a current density of between about 5 and 25 amps per square decimeter (a/dm$^2$) and a temperature of between 40° and 55° Centigrade until a chromium layer having a thickness of at least 0.25 microns is formed.

The following advantages are noted when an effective amount, typically between 4 and 12 grams per liter, of the agent is added to a chromic acid plating bath:

1. Short plating time, as short as 2½ minutes can be used to develop an adequate pattern of microcracking.
2. The microcracking agent can be used in conventional chromic acid plating baths without substantially changing the bath or without modifying existing plating equipment.
3. The microcracking agent exhibits good stability in the plating bath.
4. Electroplating can be carried out with a low concentration of $SO_4=$ ions without the deposit developing an undesirable milky appearance.
5. In some instances, the agent improves the covering power of the bath when depositing a thin, non-microcracked layer of chromium, as well as with thicker deposits.

DETAILED DESCRIPTION OF THE INVENTION

In more detail, this invention relates to the use of a particular sulfo-organic compound as a microcracking agent in a decorative chromium electroplating bath. The bath typically is made up to have the following composition:

| COMPONENT | BROAD | PREFERRED |
|---|---|---|
| $CrO_3$ | 150–380 g/l | 200–250 g/l |
| $SiF_6^=$ | .6–5.1 g/l | 1.2–3.0 g/l |
| $H_3BO_3$ | 5 g/l - sat. | 10–20 g/l |
| $SO_4^=$ | Sufficient amount to result in a weight ratio of $CrO_3/SO_4^=$ of between 150 to 1 and 600 to 1. | |

Alternatively, a fluoride-free bath having between 150 and 380 g/l of $CrO_3$ and sufficient $SO_4=$ to give a $CrO_3/SO_4=$ ratio of between 80 to 1 and 200 to 1 can be used.

To either of the aforementioned baths is added the novel microcracking agent, which appears to act as a stress inducing agent. This compound is selected from one of two groups of compounds as follows:

A. A compound having the formula:

$$Z_1-CH_2-S(O)_n-CH_2-Z_2$$

where $Z_1$ and $Z_2$ are individually selected from the group consisting of —CHO, $-CH_3$, $-CH_2OH$ and —COOH or a soluble salt thereof and where n is a whole number between 0 and 2.

B. A compound having the formula as follows:

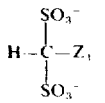

wherein $Z_1$ is likewise selected from the group consisting of —CHO, $-CH_3$, —CHOH and COOH or a soluble salt thereof.

The following are exemplary compounds from the first group:

$HOCH_2CH_2-S-CH_2CH_2OH$ (thio diethanol)

$HOOCH_2C-S-CH_2COOH$ (thio diacetic acid)

$HOCH_2-CH_2-\overset{O}{\overset{\|}{S}}-CH_2CH_2OH$ - (diethanol sulfoxide)

$OHC-H_2C-\overset{O}{\underset{O}{\overset{\|}{\underset{\|}{S}}}}-CH_2CHO$ (diacetaldehyde sulfone)

$HOOCCH_2-\overset{O}{\underset{O}{\overset{\|}{\underset{\|}{S}}}}-CH_2COOH$ - (sulfonyl diacetic acid)

Although the groups on either side of sulfur atom in the above mentioned compounds are the same, it should be noted that the groups can be different. For instance, one group can be an alcohol while the other is a carboxylic acid or its salt. Each of these compounds, when added to a plating bath in an amount between 4 and 12 g/l, is effective in developing a microcrack pattern in the electrodeposited layer of chromium. Because the compounds listed are apparently oxidized in the bath by chromic acid to the carboxy-sulfone material, addition of a smaller amount of the precursor compound is as effective as addition of a larger amount of the fully oxidized compound, the effectiveness being generally dependent on the molar concentration of the additive compound.

The second group of compounds has also been found to be effective in producing a uniformly microporous deposit when added in an amount of between 4 and 12 g/l.

Among members of this group are the following compounds:

$OHC-CH(SO_3K)_2$ Acetaldehyde disulfonate $HOCH_2-CH(SO_3K)_2$ Ethanol disulfonate $HOOC-CH(SO_3H)_2$ Disulfonic acetic acid The compounds in this group as well as the sulfones, sulfoxides and sulfide compounds of the first group can all be prepared by techniques known to the skilled organic chemist.

In utilizing the present invention, an electrodeposit of chromium is applied to a suitable conductive substrate such as nickel, cobalt or an alloy of the two. This substrate may itself comprise an electrodeposit over one or more copper or other deposits on an ultimate substrate of a metallic or non-metallic surface which has been suitably prepared. The chromium is typically deposited as a very thin layer having a thickness between 0.25 and 2.5 microns on top of a bright or lustrous nickel or cobalt layer to give a final product that is itself bright or lustrous.

Plating is carried out in a bath that normally requires no external agitation. The bubbling gases that evolve at the anode and cathode provide sufficient agitation to keep the bath components well mixed. The temperature of the bath is maintained at between 40°C and 55°C. It is noted, that when using the microcracking agents of the present invention, plating at the upper limits of the temperature range results in a reduction of the crack throwing power, i.e. the ability to form a crack pattern in recesses and other areas of low current densities, of the bath. This is somewhat counterbalanced by the fact that a crack pattern occurs more rapidly at higher temperature. Thus, if the current density is uniform and the substrate being plated is not irregular in shape, higher plating temperature, accompanied by shorter plating times, are preferred. Under normal circumstances, however, a preferred temperature range for plating is between 42°C and 46°C.

Chromium plating using the bath of this invention is carried out at a current density of at least 5 a/dm$^2$ and generally not above 25 a/dm$^2$. An average current density of about 15 a/dm$^2$ is typical and minimizes the possibility the chromium layer will be too thin at lower current densities to produce cracking during reasonable plating times. Burning of the deposit which is likely to occur at high current densities is generally avoided at the above typical current densities.

A plating time of between about 2.5 and 10 minutes and preferably between about 3 and 8 minutes is required to give a deposit of adequate thickness to form a fine microcrack pattern. If the layer is too thin it is likely to have sparse microporosity; however, as the thickness increases, the micropore density likewise increases until, beginning at a thickness of about .25 microns, a definite microcrack pattern is formed.

A good microcrack pattern contains between about 100 and 1,000 fine cracks per lineal centimeter as opposed to a macrocrack pattern which contains on the order of 25 cracks per lineal centimeter. The microcracked surface does not have a spangled appearance which is characterized by relatively large surface areas each surrounded by cracks, giving a coarse microcrack pattern with some of these relatively large areas containing a network of cracks, giving a fine microcrack pattern. A spangled surface has a generally mottled appearance and is less attractive after corrosion than a uniformly fine microcrack pattern.

Microcracking does not occur to any appreciable extent during plating. Instead, the fine microcrack pattern is developed after plating by exposure of the chromium to a corrosive atmosphere or as the result of normal aging. Microcrack formation can be accelerated by immersing the plated article in hot water. at, e.g. a temperature of between 80° C. and 100° C., or in concentrated nitric acid. Also, the formation of microcracks can be induced by subjecting the article to an artificially induced corrosive atmosphere such as that used for Cass or Corrodkote testing.

The ranges and utilities of the chemicals in a standard chromic acid plating bath are all well known and documented. For example, the chromium trioxide forms chromic acid in the bath and is a source of hexavalent chromium ions which are reduced and are deposited as metallic chromium onto the conductive surface. The sulfate ion normally added to the bath as sulfuric acid or as a soluble alkaline earth or alkali metal sulfate, acts as a catalyst in securing the bright appearance of the deposit. The $SO_4$ = increases the crack throw of the bath, which is the ability of the deposited chromium to form microcracks, even in recesses and other areas where the chromium deposit is thin. Conversely, an excess of sulfate ions decreases the bath's covering power, that is the power to deposit chromium in the recess areas.

Fluoride ions added to the bath as $SiF_6$ =, fluoborate, sodium fluoride, HF, $H_2TiF_6$ or other soluble form display catalytic activity in the bath, thus serving to promote the deposition of bright chromium and the formation of microcracks.

Boric acid, although not essential to the operation of the bath, does, when present, serve to improve the covering power of the same. If used at all, the boric acid should be present in the amount of at least 5 g/l to saturation. A preferred range is between 10 and 20 g/l. When present in amounts less than 5 g/l, the boric acid can have a detrimental effect on the operation of the bath.

Use of a selenium compound such as sodium selenate, in an amount between about 0.003 and about 0.02 g/l of $Na_2SeO_4$ or its equivalent, while not essential to the operation of the bath, serves to promote microcracking of the chromium. This makes possible a shorter plating time, a reduced current density, or both to secure an adequate microcrack pattern. As is well known to the experienced in the art of chromium plating, excessive amounts of selenium compounds result in the deposit having a blue appearance. Hence, the amount of sodium selenate used is generally limited to not over 0.01 g/l.

A bath containing only sulfate ions as the "catalyst" will serve to provide microcracking when the sulfur containing compounds of this invention are present. However, such a bath requires a larger amount of sulfate ion than when a fluorine containing ion is present. This greater amount of sulfate reduces the covering power of the chromium. Also, such a bath requires a greater concentration of the sulfur containing compound to secure microcracking. Further, the microcracked chromium secured in the absence of a fluorine containing catalyst additive tends to be less uniform in its crack pattern than when the fluoride catalyst is present.

As with the fluorine compound containing baths, a chromium plating bath containing sulfate and sulfur containing compounds which are present according to this invention, has its microcracking properties enhanced by inclusion in the bath of an effective amount of a soluble selenium compound.

The following examples are presented to more fully explain the operation of the present invention:

EXAMPLE 1

Flat steel panels 3.8 × 15.3 centimeters were plated for 18 minutes in a bright acid copper bath at 4 a/dm². They were then plated for 12–15 minutes with nickel from a standard bright nickel plating bath at 140° F. using a current density of 4 a/dm².

One control panel was plated with a layer of chromium in a bath having the following composition:

| | |
|---|---|
| $CrO_3$ | 200 g/l |
| $SO_4^=$ | .6 g/l |
| $H_3BO_3$ | 15 g/l |
| Fluorosilic acid | 1.5 g/l |

Plating was carried out at 16 a/dm² for three minutes.

To this bath was added five g/l of dihydroxyethyl sulfone. Panel No. 2 was plated for 4 minutes at 16 a/dm² and panel No. 3 for 5 minutes at the same current density (16 a/dm²), both at 49° C. Panel No. 4 was plated in a similar bath containing 8 g/l of the sulfone compound, also at 16 a/dm² for 3 minutes at 49° C.

After plating, the panels were immersed in water at 88° C. for 2 minutes and were then subjected to a Dubpernell Test to permit a visual observation of the microcrack formation. In the Dubpernell Test, the four panels were made cathodic in a bath of 250 g/l of $CuSO_4$ and 25 g/l of $H_2SO_4$ for 2 minutes at 0.3 volts to deposit copper in the cracks. Panel No. 1 plated in the chromium bath containing no sulfone compound developed a coarse macrocrack pattern. Panels 2, 3 and 4, however, when plated from a bath containing the sulfone compound of the present invention, were all found to have a well developed and uniform microcrack pattern. When additional panels, plated under conditions similar to those used for panels 2, 3 and 4, were subjected to a standard corrodkote test, there was no penetration to the base metal even after 100 hours of exposure whereas severe pitting occurred on a control panel identical to panel 1 after only 20 hours of exposure.

Additional tests carried out on variations of this bath which included dihydroxyethyl sulfone revealed the following:

A. The preferred concentration of $SO_4$ = is between 0.4 and 1.0 g/l. Increasing the $SO_4$ = concentration above this upper limit causes a severe reduction in the covering power of chromium.

B. The use of the sulfone compound in large amounts also reduces the covering power of the bath. A range of between 4.5 and 6.0 g/l was found to be a preferable range.

C. The covering power of the chromium bath is slightly better at 43° C. than at 49° C.

D. A minimum plating time of 2.5 minutes is required to obtain adequate microcracking at moderate current densities. At low current densities below 10 a/dm², minimum plating times of six minutes are required to obtain microcracking.

E. This dihydroxyethyl sulfone, particularly when used with low levels of $SO_4$= (0.3 – 5 g/l) improves the covering power of the bath when depositing thin decorative, non-microcracking chromium deposits.

EXAMPLE 2

Two plating baths were prepared as follows:

| | Bath No. 1 | Bath No. 2 |
|---|---|---|
| $CrO_3$ | 200 g/l | 200 g/l |
| $SO_4^=$ | .20 g/l | .5 g/l |
| $H_3BO_3$ | 15 g/l | 15 g/l |
| $SiF_6^=$ | 1.5 g/l | .9 g/l |

Flat steel panels of the type used in Example 1 plated with a layer of bright nickel were used. Five grams of acetaldehyde disulfonate were added to bath No. 1 and 3.5 g/l of the disulfonate were added to bath No. 2 after which panels were plated at 16 a/dm² and 47° – 49° C. for 3 to 4 minutes. These panels as well as two control panels plated from the same baths before the addition of the disulfonate were immersed in hot water and were then subjected to a Dubpernell Test. A good flat panel microcrack pattern was noted on the panels plated from the baths containing the disulfonate. Conversely, macrocracks were formed on the control panels.

EXAMPLE 3

A non-fluoride plating bath was prepared as follows:

| | |
|---|---|
| $CrO_3$ | 200 g/l |
| $SO_4^=$ | 1.5 g/l |

To this bath was added 10 g/l of dihydroxyethyl sulfide. After allowing time for the oxidation reaction to proceed, and a period of dummying, panels were plated at 16 a/dm² at 49° C. Although some microcracking of the chromium occurred in a 6 minute deposit, the microcracking was finer and had a more uniform deposit with 8 minute deposition time. Addition of 0.005 g/l of sodium selenate gave somewhat finer, more uniform cracking.

Thus, the examples clearly illustrate the marked improvement in microcrack formation resulting from the inclusion of specific sulfur-organic compounds in an aqueous chromium plating bath.

Although the foregoing has described the invention and has provided details for making and using the invention, it is not to be construed as a limitation thereof.

Instead, the protection of this invention is limited by the following claims.

1. The method of electroplating a microcracked layer of chromium onto a conductive substrate comprising electrolyzing an aqueous bath, said bath consisting of a. A chromium compound for providing hexavalent chromium ions, b. An effective amount of at least one catalyst selected from the group consisting of sulfate ions, simple fluoride ions, complex fluoride ions and mixtures thereof, and c. Optionally $H_3BO_3$ in an amount between 5 grams per liter and saturation, and/or between about 0.003 and 0.02 grams/liter of $Na_2SeO_4$, to which has been added: 4 – 12 grams/liter of an organic sulfur compound, said compound selected from the group consisting of 1. A compound having the formula $$Z_1-CH_2-S(O)_n-CH_2-Z_2$$

where $n$ is 0, 1 or 2, and

2. A compound containing the anion $$\begin{array}{c} SO_3^- \\ | \\ HC-Z_1 \\ | \\ SO_3^- \end{array}$$

wherein $Z_1$ and $Z_2$ are organic radicals independently chosen from the group consisting of $-CH_3$ $-CH_2OH$ $-CHO$ and $-COOH$ and depositing a layer of chromium from said bath onto the surface of the conductive substrate immersed in said bath.

2. The method of claim 1 wherein the chromium compound is $CrO_3$ present in an amount of between 150 and 380 g/l.

3. The method of claim 1 wherein the plating bath contains complex fluoride ions present as $SiF_6^=$ in a concentration of between 0.6 and 5.1 g/l and $SO_4^=$ ions in a sufficient amount to result in a weight ratio of $CrO_3/SO_4^=$ of between 150 to 1 and 600 to 1.

4. The method of claim 1 wherein the bath contains $SO_4^=$ ions as the sole catalyst in a sufficient amount to result in a weight ratio of $CrO_3/SO_4^=$ of between 80 to 1 and 200 to 1.

5. The method of claim 1 wherein the chromium is deposited to a thickness of between about 0.25 microns and 3.5 microns.

6. The method of claim 5 wherein the temperature of the chromium plating bath is maintained at between 40° and 55° C during plating.

7. The process of claim 6 wherein plating is carried out at a current density of between about 5 and about 25 amps per square decimeter.

8. The process of claim 7 wherein the plating time is between 2.5 and 10 minutes.

9. The method of claim 1 in which the plating bath contains between 0.003 and about 0.02 grams/liter of sodium selenate.

10. In an aqueous electrolytic plating bath for electrodepositing microcracked chromium consisting of a. Between 150 grams per liter and 380 grams per liter of $CrO_3$, and b. An effective amount of at least one catalyst selected from the group consisting of sulfate ions, simple flouride ions, complex fluoride ions and mixtures thereof, and c. Optionally at least 5 grams/liter of $H_3BO_3$ and/or between about 0.003 and 0.02 grams/liter of $Na_2SeO_4$, the improvement comprising the inclusion of between 4 and 12 g/l of an organic sulfur compound selected from the group consisting of 1. A compound having the formula $$Z_1-CH_2-S(O)_n-CH_2-Z_2$$

where $n$ is 0, 1 or 2, and

2. A compound containing the anion

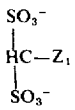
wherein $Z_1$ and $Z_2$ are independently chosen from the group consisting of
$-CH_3$
$-CH_2OH$
$-CHO$
and
$-COOH$.
* * * * *